United States Patent [19]

Knepper, Jr.

[11] 4,192,034

[45] Mar. 11, 1980

[54] BOWLING BALL CLEANER WITH PNEUMATIC CONTROL OF BALL LIFT, BRUSHES AND CLEANING COMPOUND

[75] Inventor: William H. Knepper, Jr., Mansfield, Ohio

[73] Assignee: AMF Incorporated, White Plains, N.Y.

[21] Appl. No.: 936,531

[22] Filed: Aug. 24, 1978

[51] Int. Cl.[2] ..... A63B 47/04

[52] U.S. Cl. ..... 15/21 A; 222/389

[58] Field of Search ..... 15/21 A, 21 D, 21 E, 15/31, 34, 97 R, 230; 222/389

[56] References Cited

U.S. PATENT DOCUMENTS

| | | | |
|---|---|---|---|
| 1,822,419 | 9/1931 | Raschella | 15/34 |
| 2,321,162 | 6/1943 | Sohm | 15/21 A |
| 2,322,808 | 6/1943 | Hothersall | 222/389 X |
| 2,392,237 | 1/1946 | Falese | 15/21 D |
| 2,588,714 | 3/1952 | Fleming | 15/21 A X |
| 3,066,338 | 12/1962 | Nappi | 15/34 |
| 3,249,957 | 5/1966 | Secord | 15/21 A |
| 3,402,415 | 9/1968 | Berlin | 15/21 A X |
| 3,748,677 | 7/1973 | Frank et al. | 15/21 D |

FOREIGN PATENT DOCUMENTS

| | | | |
|---|---|---|---|
| 906510 | 9/1962 | United Kingdom | 15/230 |

*Primary Examiner*—Edward L. Roberts

*Attorney, Agent, or Firm*—George W. Price; Walter Lewis

[57] ABSTRACT

A bowling ball cleaner having pneumatic movement of the ball lift and a cotton strand brush, and atomized deposit of cleaning compound to the brush.

6 Claims, 2 Drawing Figures

BOWLING BALL CLEANER WITH PNEUMATIC CONTROL OF BALL LIFT, BRUSHES AND CLEANING COMPOUND

This invention relates to a bowling ball cleaner and polisher, and more particularly, to one having pneumatic movement of the ball lift and a pair of cotton strand brushes, and pneumatic atomized deposit of the cleaning compound on to one of the brushes.

Briefly, this invention is an improvement in a bowling ball cleaner and polisher of the type shown in the assignee's prior U.S. Pat. No. 3,249,957 to J. C. Secord dated May 10, 1966. In the instant invention the ball lift, brushes and cleaning compound are pneumatically moved and/or controlled and cotton strand brushes are employed.

Figure 1:
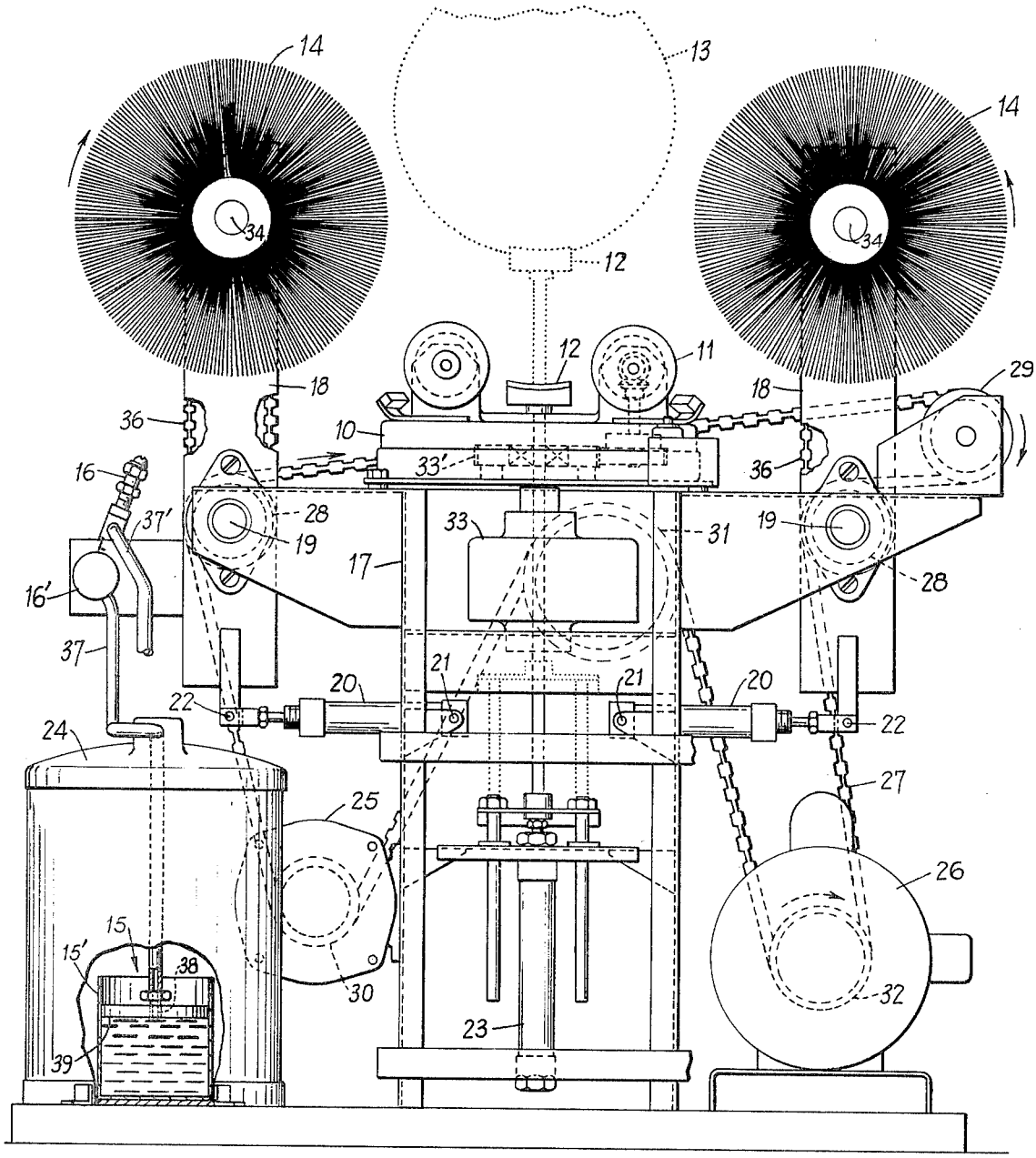
Figure 2:
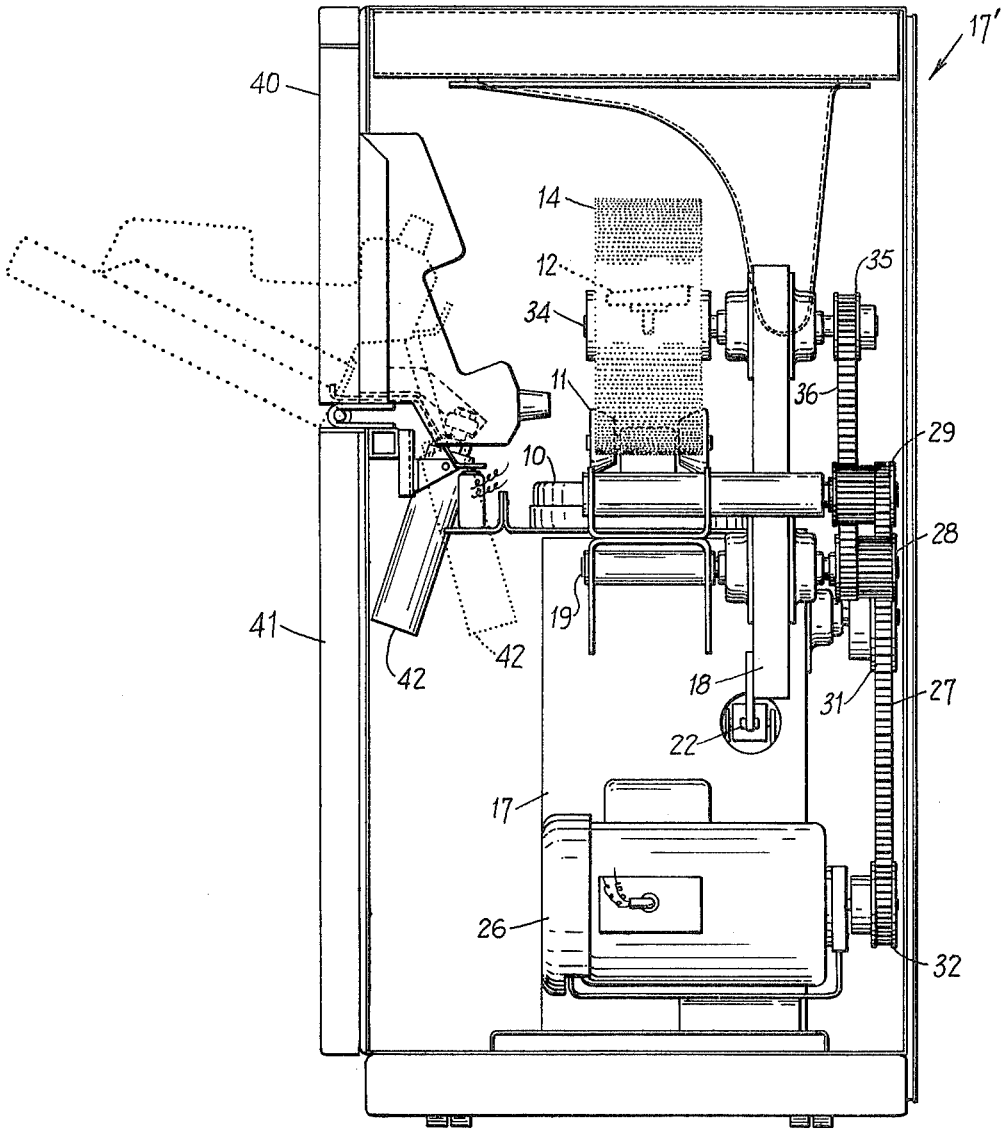

These features are for the purposes and advantages to be noted hereinafter in the ensuing description taken in connection with the accompanying two sheets of drawings in which FIG. 1 is a broken away front view of the improved device, and FIG. 2 is a broken away side view of the device when viewed from the right of FIG. 1. In view of the state of the art only those parts are shown and described which are necessary for an understanding of the claimed invention.

Referring now to FIGS. 1 and 2 together, the device comprises a turntable 10, two pairs of cone shaped wheels 11 on the table, and a central ball lift 12 between the cone wheels. The lift 12 lifts a bowling ball 13 off the cone wheels 11 or lowers same on to the cone wheels. One pair of the cone wheels is driven to rotate the ball about a horizontal axis, and the turntable is driven to rotate the ball about a vertical axis.

Positioned along opposite sides of the turntable are a pair of cotton strand brushes 14. These brushes have a high density of radially extending cotton strands. The left brush 14 is adapted to have a slurry of cleaning compound 15 deposited thereon as a fine atomized spray by a pneumatic atomizer nozzle 16. So, the left brush 14 is the cleaning brush, whereas the right brush is the final polish brush.

The turntable subassembly 10, 11 is supported on a frame indicated generally by reference numeral 17. The brushes also are pivotally supported off this same frame on a pair of pivoted brush arms 18 on pivot axes 19. The brushes are rotatably mounted on the upper ends of the arms 18. The lower ends of arms 18 are adapted to be swung in or out by a pair of single acting pneumatic cylinders 20 to swing the brushes away or towards the ball 13. The cylinders are also mounted on the frame 17 and have a pivotal connection at their opposite ends to the frame 17 and arms 18 at pivot axes 21, 22 respectively.

The ball lift-drop plunger 12 is alternately raised or lowered by a double acting pneumatic cylinder 23 at the bottom of the frame 17. This cylinder is vertical whereas the other two are horizontal.

The cleaning compound slurry is in a can 15' located inside an air tank 24 pressurized to about 40–55 psi by an air compressor 25. The compressor is driven by an electric motor 26. The same is true of the turntable 10, one pair of the cone wheels 11 and the brushes 14. Briefly, this is done by a toothed timing belt 27, which, starting at the motor 26, first progresses up to around a right-hand toothed brush drive pulley or wheel 28, then around an adjustable belt tension idler wheel 29, then across the back of the unit to another brush drive pulley or wheel 28, then down to and around a compressor drive wheel 30, and then up and around a speed reducer drive wheel 31, and then back down to a drive wheel 32 on the motor 26.

The speed reducer wheel 31 drives a set of not shown gears in a speed reducer gear box 33. The upper output end of the gear box turns the turntable 10, and the rotating turntable through some gearing 33' turns one pair of the cone wheels 11. The brushes 14 are rotated about axes 34 which include brush drive wheels 35. These wheels 35 are driven off the other brush drive wheels 28 by a pair of timing belts 36, the wheels 28 being on the pivot axes 19 for the swing arms 18.

Briefly, the parts shown in FIG. 1 are assembled together inside a box or compartment 17' shown in FIG. 2 as having upper and lower front doors 40, 41 respectively. After the top door is opened, the ball 13 can be placed in position. After the door is closed, the plunger 12 will lower in response to the air cylinder 23 to drop the ball on the cone wheels 11. Then the left-hand brush 14 will receive an atomized spray of the cleaning compound slurry 15 from the can 15' inside the air pressure tank 24 by the nozzle 16. The tank 24 is pressurized by the compressor 25 which is driven by the motor 26. When the motor 26 is turning to drive the compressor 25, the brushes 14, turn-table 10, and one pair of the cone wheels 11 are simultaneously driven by the pulley-belt system 27-32 and pulley-belt systems 28, 35, 36. As will be obvious to those skilled in the art, not shown timed electrically operated air valves connect the air cylinders 20, 23 and nozzle 16 to the compressed air tank 24 so that those parts belong to a total pneumatic air system which, of course, includes the compressor 25. Suffice to say that at the proper time the left-hand air cylinder 20 will swing the left-hand brush 14 into contact with the ball 13 to clean same, then it will withdraw, and then the right-hand air cylinder 20 will swing the right-hand brush 14 into the ball to polish the same, and then withdraw, and then the air cylinder 23 will raise the polished ball off the turntable after which the device will shut off and the door opened to remove the ball. If desired, an air cylinder 42 shown in FIG. 2 can be used to open and close the door 40 automatically.

The above described arrangement has several advantages. The nozzle 16 delivers a controlled amount of cleaning compound to the left cleaning brush 14 so it is easier to keep the system clean. In particular, the brush will not become caked with cleaning compound; and since it comprises cotton strands, the tips of the strands are slowly worn by their action on the ball to give a self-cleaning affect on the brush.

When the can 15' is empty, it is very easy to replenish the cleaning compound slurry 15 merely by putting in a fresh can 15' of same. That is to say, after bottom door 41 is opened, the air system is first de-pressurized as a safety precaution, then the cover for tank 24 removed, and can 15' simply replaced with a fresh one and tank 24 then reclosed. A flexible air hose 37 extends from a nozzle valve 16' and through the cover of tank 24 into a central aperature 38 formed in a compound slurry float disc 39 located inside can 15' on top of the cleaning compound slurry 15, and an air line 37' connects the nozzle 16 to the air tank 24. The air pressure inside tank 24 bears down on the float disc 39 so that when nozzle valve 16' is operated the slurry 15 is simultaneously forced up the hose 37 and air at the nozzle 16 from line 37' atomizes it into a fine spray on to the cleaning brush 14. Thus, it will be seen that the invention provides an improved system for metering cleaning compound to the cleaning brush and also for easy periodical replenishing of the same.

The air cylinders 20, 23 of course provide positive movement of the brushes 14 and the ball lift-drop plunger 12, and the toothed pulley-belt drive system 27, 28–32 and 28, 35, 36 is also a positive drive, so there is minimal mechanical slippage or lost motion in the device.

I claim:

1. In a bowling ball cleaner having means for rotating the ball and a rotary brush engageable with the ball to clean the same, said cleaner including a spray nozzle adjacent to said brush, a container of cleaning compound slurry, and hose means connecting said container to said nozzle for depositing a spray of said slurry on said brush, a compressed air tank, said container of slurry comprising a replaceable open can of said slurry in said tank, a float disc in said can resting on top of said slurry, and said hose means extending to an aperture formed in said disc.

2. In a cleaner as in claim 1, said means for rotating the ball comprising a turntable, a ball lift plunger in said turntable for raising the ball off said table, air cylinders for moving said plunger and engaging said brush with said ball, said nozzle and cylinders being operated off said air tank.

3. In a cleaner as in claim 2, a compressor for charging said air tank, an electric motor for operating said compressor, and toothed timing belt-pulley means for operating said compressor, turntable, and brush off said motor.

4. In a bowling ball cleaner having a ball lift-drop plunger and a pair of swing arms for swinging a pair of rotary brushes into contact with a ball positioned above said plunger, an air cylinder for each of said arms and plunger, a compressed air tank, and each of said cylinders being operated off said compressed air tank.

5. In a cleaner as in claim 4, a container of cleaning compound slurry, a nozzle for delivering a spray of said slurry to one of said brushes, said nozzle being operated off said compressed air tank.

6. In a cleaner as in claim 5, said container of slurry comprising a replaceable can of said slurry inside said tank, and said pair of brushes having a high density of radially extending cotton strands.

* * * * *